US005287840A

United States Patent [19]

Catanu et al.

[11] Patent Number: 5,287,840

[45] Date of Patent: Feb. 22, 1994

[54] CAM SECTIONS FOR A "V"-TYPE DIESEL ENGINE

[75] Inventors: Catalina Z. B. Catanu, Montreal; Yao S. Lu, Quebec, both of Canada

[73] Assignee: General Electric Canada Inc., Mississauga, Canada

[21] Appl. No.: 922,581

[22] Filed: Jul. 30, 1992

[51] Int. Cl.[5] ..... F02M 37/04

[52] U.S. Cl. ..... 123/508; 74/567; 123/90.6

[58] Field of Search ..... 123/508, 90.6; 74/567, 74/568

[56] References Cited

U.S. PATENT DOCUMENTS

| | | | |
|---|---|---|---|
| 4,412,513 | 11/1983 | Obermayer et al. | 123/508 |
| 4,538,561 | 9/1985 | Amemori et al. | 123/508 |
| 4,721,075 | 1/1988 | Kasai | 123/508 |
| 4,739,733 | 4/1988 | Hartmann et al. | 123/508 |

*Primary Examiner*—E. Rollins Cross

*Assistant Examiner*—Thomas Moulis

*Attorney, Agent, or Firm*—R. Thomas Payne

[57] ABSTRACT

A unit cam section for each bank of cylinders in a "V"-type engine has a predetermined cam orientation between the fuel cam and the air cam and between the fuel cam and the exhaust cam wherein a first unit cam section has a fuel cam to air cam angle of between 56° and 63° and a fuel cam to exhaust cam angle of between 143° and 153° and a second unit cam section has a fuel cam to air cam angle of between 0° and 7° and a fuel cam to exhaust cam angle of between 88° and 98°. Each cam has a base circle diameter of at least 3.75 inches. An improved "V"-type diesel engine is disclosed which has multiple banks of cylinders such that one bank employs the first type of unit cam section and the other bank employs the second type of unit cam section wherein each cylinder has a corresponding inverted fuel rocker mechanism for engaging the fuel cam. Each fuel cam is adapted to provide a fuel cam lift to fuel pump plunger lift ratio of at least 0.8:1.0.

11 Claims, 5 Drawing Sheets

CAM SECTIONS FOR A "V"-TYPE DIESEL ENGINE

BACKGROUND OF THE INVENTION

The invention relates generally to fuel injected diesel engines and more particularly to direct injection type diesel engines having inverted fuel rocker mechanisms such as "V"-type engines suitable for use in locomotive, stationary and marine applications.

Improved engine efficiency has been a primary goal for diesel engine designers but has proved to be a difficult task particularly for older, larger and proven engine designs. With larger engines, a small fraction of a percentage increase in fuel efficiency can translate into a substantial cost savings over time. One such diesel engine is the ALCO Model 251 Series "V"-type diesel engine previously manufactured under license by Bombardier Inc. in Quebec, Canada and now manufactured by G.E. Canada in Quebec, Canada. Since purchases of large engines require a large capital investment, it is desirable that any change to facilitate engine efficiency improvement also minimize retrofit costs and preferably require little or no change to the engine block.

Known ALCO 251 diesel "V"-type diesel engines typically include a bank of combustion cylinders on a right side of the engine and a bank of combustion cylinders on the left side of the engine. Each cylinder typically has a corresponding piston and a plurality of cams. The cams typically include a fuel cam for moving a plunger inside a fuel pump to supply fuel to the cylinder, a corresponding air cam for moving air valves typically located in the cylinder head and a corresponding exhaust cam for moving exhaust valves also typically located in the cylinder head. The fuel cam contacts a roller of an inverted rocker arm to facilitate movement of the fuel pump plunger. The cams each have a cam profile and are rotatable about a cam shaft axis and are fixedly positioned with respect to each other to form a pre-determined cam orientation.

Such diesel engines have previously been designed with CQ type fuel pumps manufactured by Lucas Bryce, Gloucester, England, and small diameter multi-cylinder cam shafts which provided a fuel cam lift to fuel pump plunger lift ratio of less than 1:1. It was found that the reliability and efficiency of such engines was limited in part by the cam shaft configuration and the linkage from the cam shaft to the valves or fuel pump plunger.

Improved diesel engines have been designed to overcome some of these problems. These engines typically include unit cam sections that provide a 1:1 fuel cam lift to fuel pump plunger lift ratio to reduce loading on the cams and camshaft which increases reliability of the engine. The unit cam design also facilitates single cylinder cam replacement through an existing opening on the side of the engine instead of removing multiple cams for multiple cylinders longitudinally through the cam shaft bearing of the engine. Other improvements have also been made such as increasing the thickness of portions of the fuel pump support to further increase the rigidity of the cam to valve linkages and modifying the fuel cam profile to facilitate higher injection pressure. Another change included switching the fuel pump to a CV type fuel pump, also manufactured by Lucas Bryce, which was believed to have improved performance characteristics.

Although it has been found that fuel efficiency has been increased by nearly 1.5% after these improvements to the ALCO 251 diesel engine, further increases in fuel efficiency would be desirable to provide a low cost and easily installable alternative to purchasing and installing a new engine. Consequently there exists a need for improving diesel engine efficiency without requiring substantial changes to existing engine designs and which can be readily incorporated with existing engine blocks.

SUMMARY OF THE INVENTION

In carrying out the present invention in a preferred form thereof, there is provided an improved unit cam section for use in a fuel injected diesel engine such as a "V"-type engine which has an inverted fuel rocker mechanism for engaging the fuel cam. One illustrated embodiment of the invention disclosed herein is in the form of unit cam sections for use in a "V"-type locomotive engine.

It is an object of the present invention to provide a more fuel efficient diesel engine, such as an improved ALCO 251 diesel engine which has an inverted fuel rocker mechanism for engaging the fuel cam.

It is another object of the invention to provide a unit cam section which facilitates improved engine efficiency and does not require redesign of existing engine blocks such as engine blocks designed for use in a diesel engines which have an inverted fuel rocker mechanism for engaging the fuel cam.

A first unit cam section for one bank of cylinders and a second unit cam section for another bank of cylinders for use in a "V"-type fuel injected diesel engine is disclosed. Each unit cam section, having a longitudinal center axis, includes a plurality of cams for a single cylinder and piston wherein each of the cams has a base circle, the center of each base circle lies along the longitudinal center axis of the unit cam section. The plurality of cams include a fuel cam, interposed between an air cam and an exhaust cam, such that the fuel cam moves a fuel pump plunger mechanism for facilitating fuel flow to a corresponding cylinder, the air cam moves corresponding air valves and the exhaust cam moves corresponding exhaust valves. Each cam has an opening flank portion and a closing flank portion and a predetermined cam profile. Each unit cam section is cooperative with an inverted fuel rocker mechanism. The unit cam sections include a base circle diameter of at least 3.75 inches for each cam. The fuel cam on each unit cam section is adapted to provide a fuel cam lift to fuel pump plunger lift ratio of at least 0.8:1.0. The unit cam sections also have a predetermined cam orientation between the fuel cam and the air cam and the fuel cam and the exhaust cam. The first unit cam section has a fuel cam to air cam angle of between 56° and 63°, and a fuel cam to exhaust cam angle of between 143° and 153°. The second unit cam section has a fuel cam to air cam angle of between 0° and 7°, and a fuel cam to exhaust cam angle of between 88° and 98°.

The fuel cam to air cam angle is defined by an angle between a fuel cam reference line and an air cam line. The fuel cam reference line is defined by a first point and a second point wherein the first point corresponds to a location of a center axis of a fuel cam roller which is at a position along the opening flank of the fuel cam where the fuel cam engages the inverted fuel rocker mechanism when the piston is at top dead center during a fuel injection portion of an engine cycle. The second point corresponds to a center axis of the base circle of the fuel cam.

The air cam line is defined by a first point corresponding to a location of a center axis of an air cam roller which is at a position along the opening flank of the air cam corresponding to a location on the opening flank of the air cam where the air cam causes the air valves to start to open. The second point for the air cam line corresponds to the center axis of the base circle of the air cam.

The fuel cam to exhaust cam angle is defined by an angle between the fuel cam reference line and an exhaust cam line. The exhaust cam line is defined by a first point corresponding to a location of a center axis of an exhaust cam roller which is at a position along the opening flank of the exhaust cam corresponding to a location on the opening flank of the exhaust cam where the exhaust cam causes the exhaust valves to start to open. The second point corresponds to the center axis of the base circle of the exhaust cam.

The first unit cam section has a preferred fuel cam to air cam angle of between 60° and 62° and a preferred fuel cam to exhaust cam angle of between 147° and 149° and a preferred lift ratio of 1:1. The second unit cam section has a preferred fuel cam to air cam angle of between 5° and 7° and a preferred fuel cam to exhaust cam angle of between 92° and 94° and a preferred lift ratio of 1:1.

An improved "V"-type direct fuel injection diesel engine incorporating the aforedescribed first and second unit cam sections is also disclosed. The engine further includes inverted fuel rocker mechanisms associated with each cylinder and cooperative with the fuel cams; fuel pumps, such as CQ type fuel pump, associated with each cylinder and having a fuel plunger mechanism responsive to the inverted fuel rocker means; and the fuel cams adapted to provide a fuel cam lift to fuel pump plunger lift ratio of at least 0.8:1.0.

Other objects and advantages of the invention will be apparent from the following description, the accompanied drawings and the appended claims.

DESCRIPTION OF THE PREFERRED EMBODIMENT

For purposes of simplicity, the following description will be made with reference to a single unit cam section for use with any one of a plurality of cylinders in one bank. However, it will be recognized that the general description also applies to a unit cam section for use in another bank of cylinders in a same diesel engine.

Figure 1:
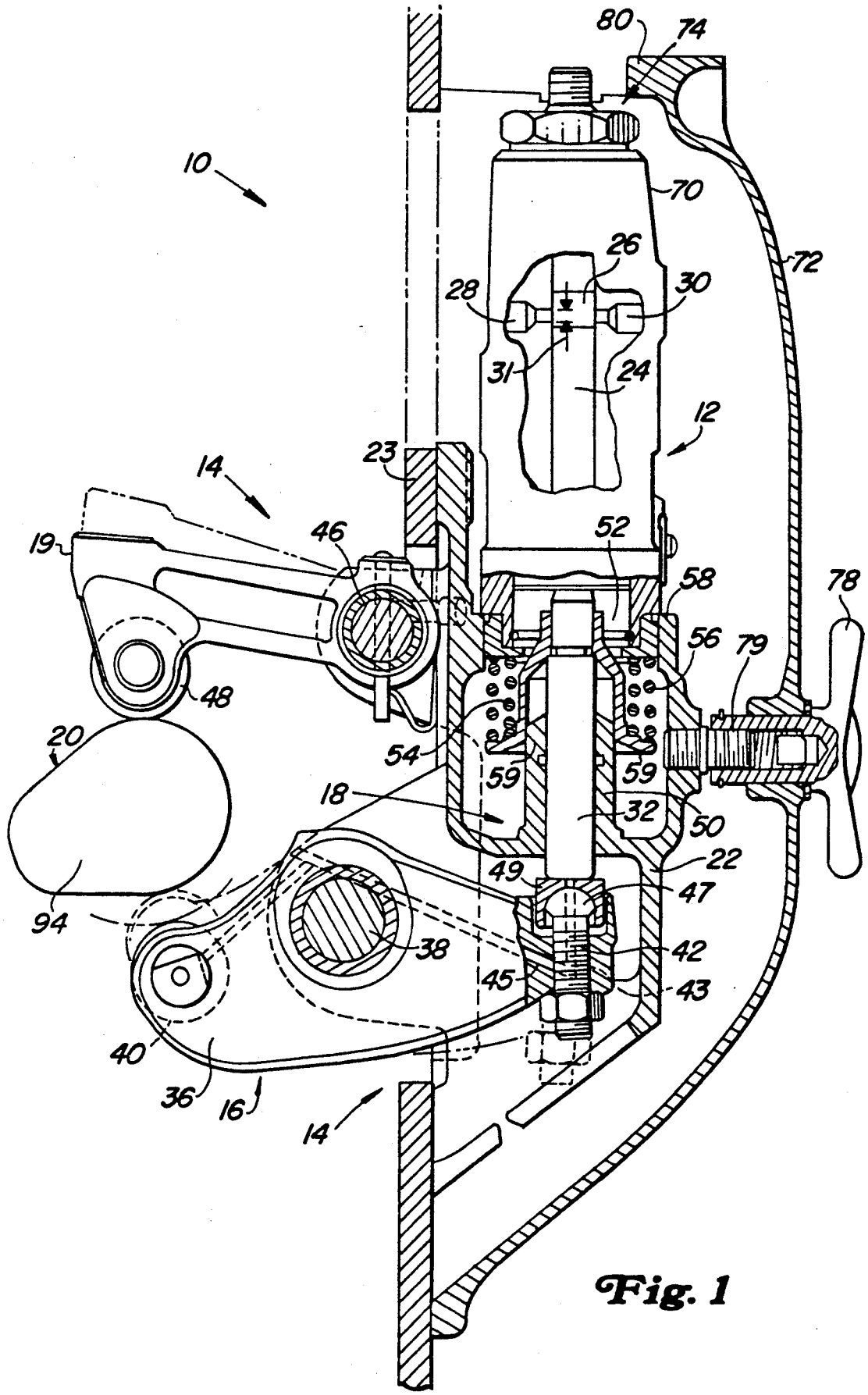
FIG. 1 is a partial cross-sectional and cutaway view of a fuel pump, lifter assembly and inventive unit cam section for use in one bank of a diesel engine.

A unit cam section embodying the present invention in one preferred form thereof is illustrated in partial form in FIGS. 1 and 2 as a fuel cam engaging a lifter assembly pertaining to a locomotive engine application such as an ALCO 251 engine. The lifter assembly couples to a fuel pump 12. The lifter assembly 14 includes an inverted fuel cam rocker mechanism 16 which is coupled to crosshead assembly 18, an air valve lifter 19 and an exhaust valve lifter (not shown). A rotating unit cam section 20 engages the lifter assembly 14 as known in the art.

The fuel pump 12 is supported above the crosshead assembly 18 by fuel pump support 22 which is fixedly mounted to the engine block 23. The fuel pump 12 includes a plunger 24 mounted for reciprocating movement in a fuel pressure chamber 26. The ports 28 and 30 allow fuel to enter and exit the fuel chamber 26. The plunger 24 is reciprocally movable to force fuel from the fuel chamber 26 out to an injection port (not shown) to supply the pressurized fuel to an engine cylinder as known in the art. The engine cylinder has a chamber for receiving a piston which compresses an air and fuel mixture to the point of ignition as well known in the art.

The fuel pump 12 is preferably a CQ type fuel pump as known in the art which is also available from Lucas Bryce, Gloucester, England. Such a pump should have injection pressure characteristics similar to those shown in FIG. 5 corresponding to the box indicating an 18CQ pump.

Figure 5:
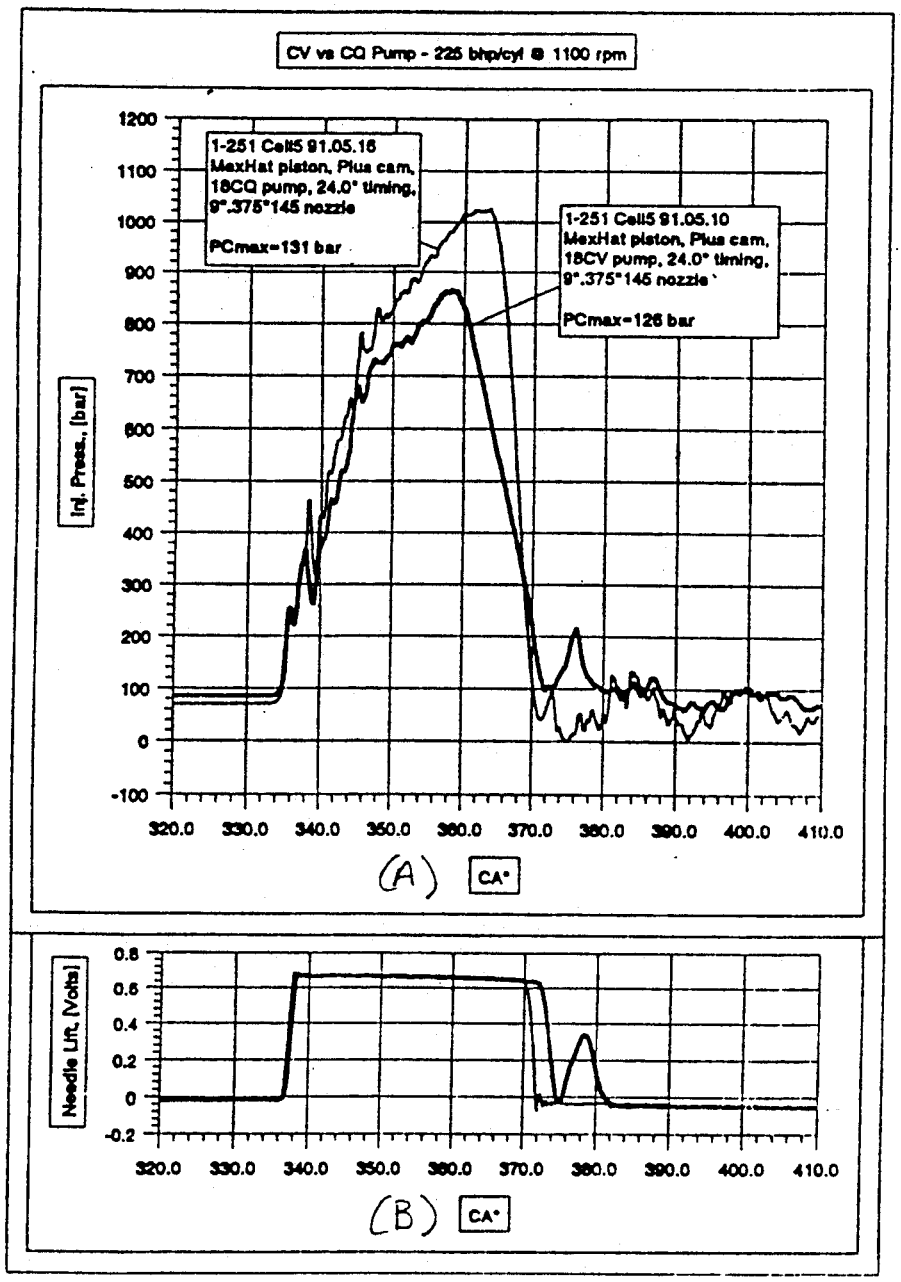
FIG. 5 shows Graph A plotting fuel pump injection pressure vs. crank angle and Graph B plotting injection needle lift vs. crank angle.

As shown in FIG. 5, Graph (A) compares the injection pressure of an 18CV pump to the 18CQ pump at various crankshaft angle positions under a constant load of approximately 225 bhp/cylinder at 1100 rpm. It was found that although current diesel engines of the ALCO 251 engines use a CV type pump, the CQ pump provides higher injection pressure and a faster rate of pressure reduction for various crankshaft angle positions.

Graph (B) shown in FIG. 5, illustrates the fuel injection needle lift over a range of crankshaft positions and shows that secondary fuel injection occurs with the CV pump between approximately 374°–382° of crankshaft angle. This secondary fuel injection tends to reduce efficiency since fuel is being unnecessarily injected at an improper crankshaft angle position.

The plunger 24 moves upwardly through the port closure distance generally indicated at 31 to close the input ports. The port closure distance 31 may be between approximately 0.117 inch and 0.177 inch. A preferred distance is a nominal 0.155 inch as is the case with an 18CQ pump.

The crosshead assembly 18 is a typical assembly which includes a crosshead 32 for pushing the plunger 24 upwardly to force fuel into the combustion cylinder. The crosshead 32 is reciprocally actuated through the movement of the fuel cam on the unit cam section 20 as it engages the rocker mechanism 16 as known in the art. The lifter assembly 14 includes an inverted rocker arm 36 pivotal about a fulcrum 38. A fuel cam roller 40 is rotatably attached to the rocker arm 36 on one side of the fulcrum 38 and an adjustment screw 42 is attached to another end of the rocker arm 36 on another side of the fulcrum 38 so that downward movement of the fuel cam roller 40 causes upward movement of the adjustment screw 42. The rocker arm 36 embodies an oil gallery 45 for supplying oil to the sliding surface of a head 47. The adjustment screw includes an annular groove 43 with cross drilling and a central drilling up to the head of the adjustment screw 47. The head 47 of the adjustment screw 42 slidably engages a crosshead contact block 49. Turning the adjustment screw 42 causes the port closure distance to change.

An air valve lifter 19 is pivotal about another fulcrum 46. The air valve lifter 19 has an air cam roller 48 attached at an end distal the fulcrum 46 for engaging the air cam (not shown) of the unit cam section 20. As known in the art, the exhaust valve lifter (not shown) is substantially identical in design to the air valve lifter 19.

The lifter assembly 14 also includes a lower spring retainer 52 which is slidably engageable with a portion of the fuel pump support generally indicated at 50. Lower spring retainer 52 is coupled to the crosshead 32. The crosshead guides the assembly through the fuel pump support 50 as it travels upwardly during actuation by the inverted rocker arm 16. A plurality of biasing springs 54 and 56 provide downward bias pressure when the crosshead 32 is moved upwardly by movement of the inverted rocker arm 16 as well known in the art. Upper and lower spring retainers 58 and 59 serve to secure the springs 54 and 56.

The plunger 24 and ports 28 and 30 of the fuel pump 12 are incorporated by a fuel pump body 70. An outer cover 72 protects the fuel pump 12 and fuel pump support 50 from the environment. The fuel pump 12 also has a threaded outlet 74 which connects to a high pressure injection tube (not shown). End portions 80 of the outer cover 72 forcibly abut portions of the engine block 23 by tightening a knob 78 which has a threaded bolt 79 for threadably coupling to the fuel pump support 22.

It will be recognized that the above cam, fuel pump and lifter assembly description applies equally well for each set of cam, fuel pump and lifter assembly associated with each of the cylinders in a bank in a "V"-type diesel engine as known in the art.

Figure 2A:
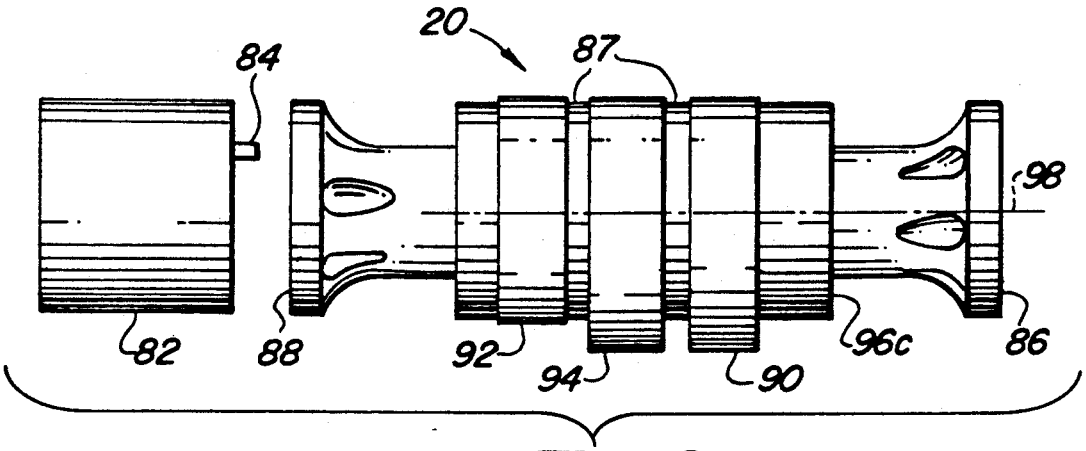
FIG. 2A is a plan view of the unit cam section of FIG. 1 in accordance with the invention.
Figure 2B:
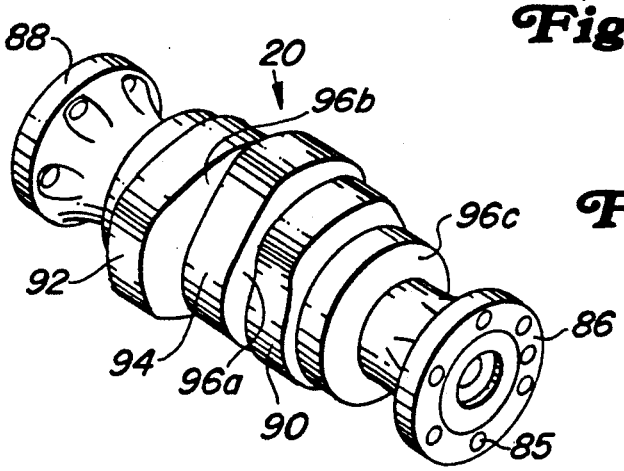
FIG. 2B is a perspective view of the unit cam section of FIG. 2A in accordance with the invention.

FIGS. 2A and 2B depict the unit cam section 20 and a connect spacer 82 which houses a dowel 84 for use in aligning one unit cam section to another. Unit cam section 20 is an integrally formed cam section typically machined from a piece of metal stock. The unit cam section 20 includes opposing ends 86 and 88 adapted with apertures 85 to connect with spacers 82 which interconnect unit cam sections together (best seen in FIG. 4). The unit cam section 20 is referred to as a unit cam section since it includes the necessary cams for a single combustion cylinder of an engine as opposed to a cam section which includes cams for multiple cylinders. The unit cam section 20 includes a plurality of cams positioned between the opposing ends 86 and 88. The plurality of cams include an air cam 90 which causes movement of air valves typically located in a cylinder head (not shown), an exhaust cam 92 for moving exhaust valves typically located in the cylinder head, and a fuel cam 94 for moving a fuel plunger 24 to allow fuel to be injected into the combustion cylinder.

The air cam 90 is adjacent to the fuel cam and the fuel cam 94 is interposed between the air cam 90 and the exhaust cam 92. The unit cam section 20 serves as one section of an elongated cam shaft. The cams 90, 92 and 94 are spaced apart longitudinally along the unit cam section for operating their respective valves. Each of the cams has a base circle 96a–96c (best seen in FIGS. 3A–3C) which has a center axis generally indicated at 98. The opposing ends 86 and 88 of this cam section 20 have a fillet radius portion extending from the opposing ends.

Figure 3A:
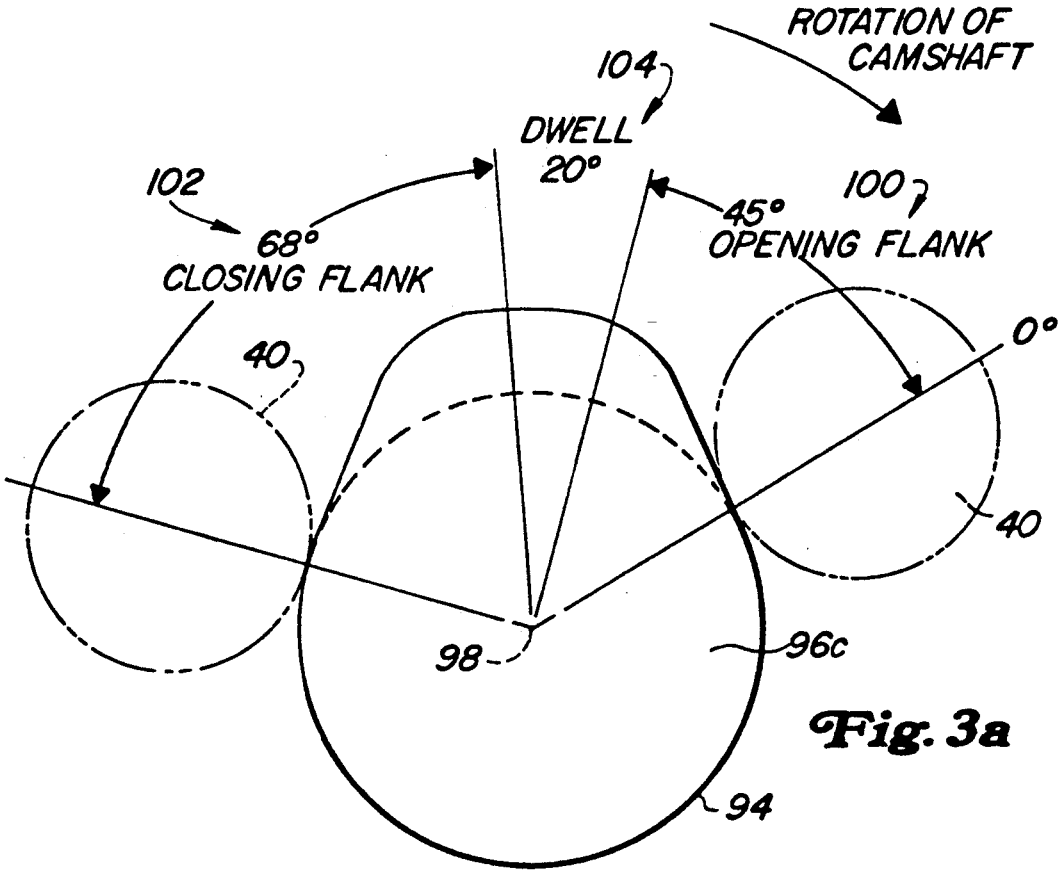
FIG. 3A is a schematic diagram of a cross-section of a fuel cam portion of a unit cam section depicting the cam profile in accordance with the invention.
Figure 3B:
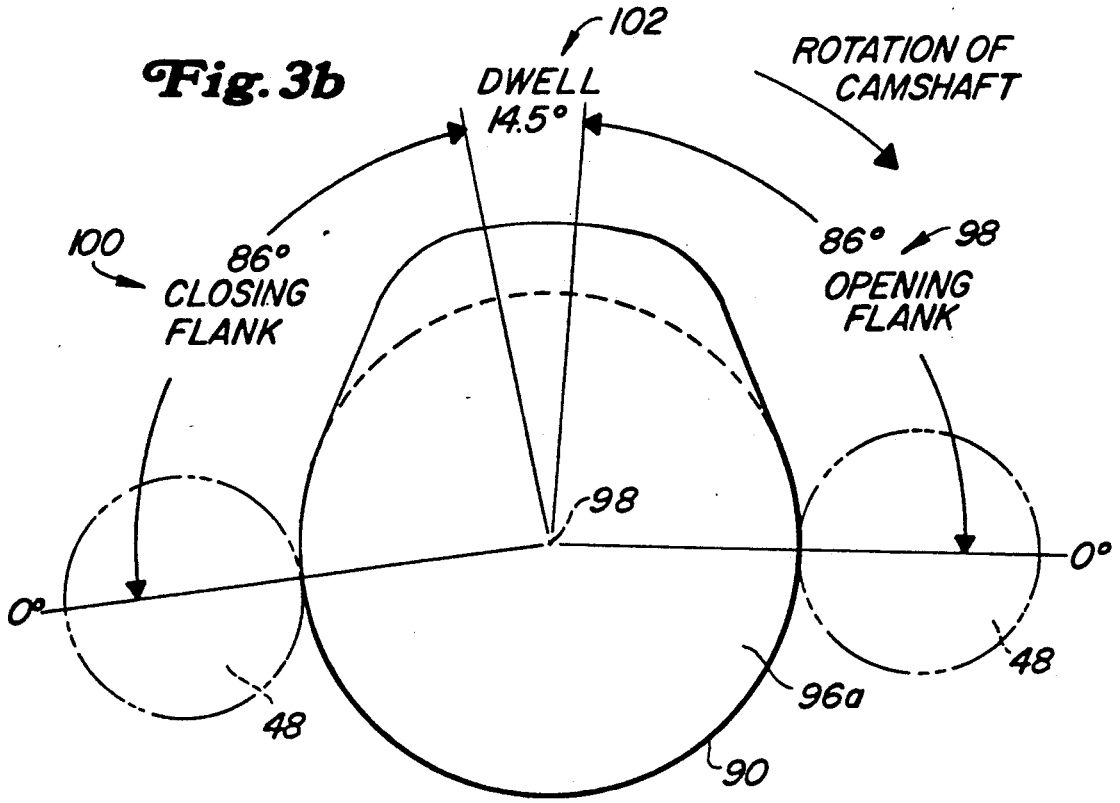
FIG. 3B is a schematic diagram of a cross-section of the air cam section depicting the cam profile in accordance with the invention.
Figure 3C:
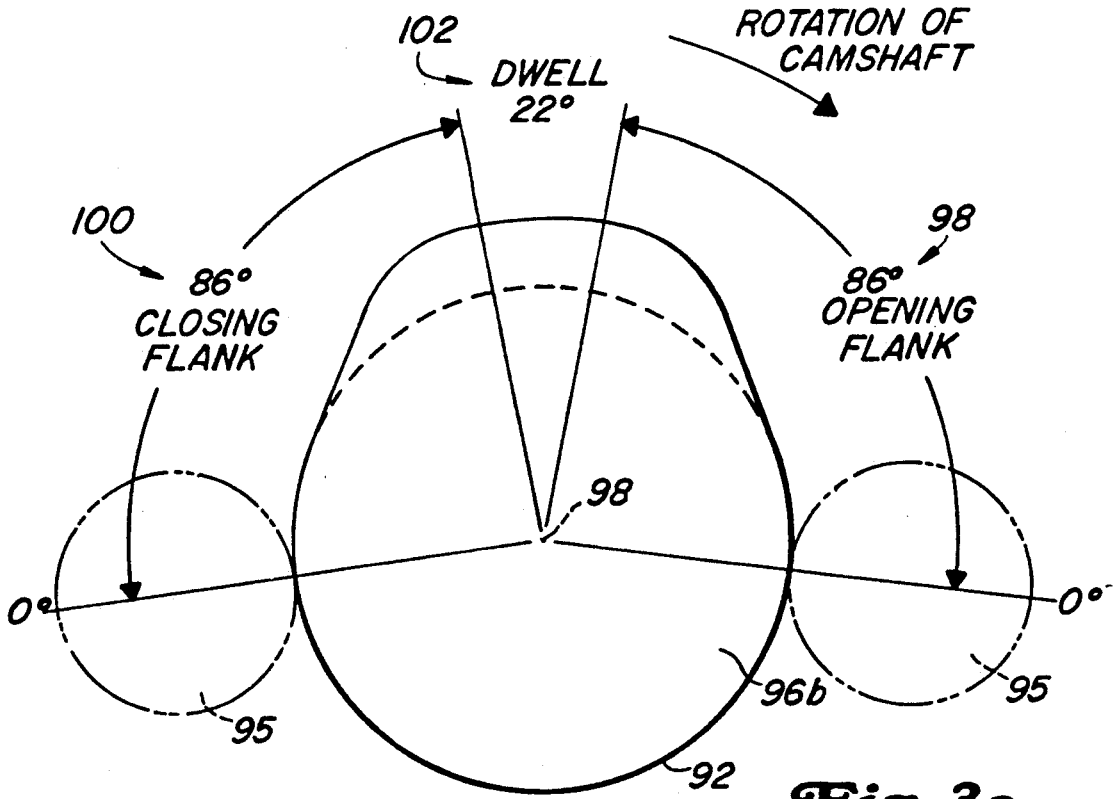
FIG. 3C is a schematic drawing of a cross-section of the exhaust cam portion of the unit cam section depicting the cam section in accordance with the invention.

FIGS. 3A–3C and associated Tables II–IV illustrate cam profiles for all unit cam sections irrespective of the particular bank or side of the engine in which they are employed. In particular, FIG. 3A and Table II define a preferred cam profile for the fuel cam 94. Table II specifies the roller lift (in inches) at cam angles of 1° increments. Similarly, FIG. 3B and Table III define a preferred cam profile for the air cam 90 and FIG. 3C and Table IV define a preferred cam profile for the exhaust cam 92.

TABLE II

| FUEL CAM PROFILE | |
|---|---|
| CAM SEC. | ROLLER LIFT |
| 0 | 0.00000 |
| 1 | 0.00091 |
| 2 | 0.00366 |
| 3 | 0.00825 |
| 4 | 0.01470 |
| 5 | 0.02303 |
| 6 | 0.03328 |
| 7 | 0.04548 |
| 8 | 0.05968 |
| 9 | 0.07594 |
| 10 | 0.09432 |
| 11 | 0.11490 |
| 12 | 0.13776 |
| 13 | 0.15303 |
| 14 | 0.19039 |
| 15 | 0.21794 |
| 16 | 0.24516 |
| 17 | 0.27208 |
| 18 | 0.29863 |
| 19 | 0.32487 |
| 20 | 0.39874 |
| 21 | 0.37630 |
| 22 | 0.40154 |
| 23 | 0.42647 |
| 24 | 0.45108 |
| 25 | 0.47538 |
| 26 | 0.49837 |
| 27 | 0.52304 |
| 28 | 0.54540 |
| 29 | 0.56844 |
| 30 | 0.59247 |
| 31 | 0.51458 |
| 32 | 0.63668 |
| 33 | 0.55721 |
| 34 | 0.67615 |
| 35 | 0.69351 |
| 36 | 0.70930 |
| 37 | 0.72351 |
| 38 | 0.73643 |
| 39 | 0.74718 |
| 40 | 0.75666 |
| 41 | 0.75455 |
| 42 | 0.77086 |
| 43 | 0.77560 |
| 44 | 0.77876 |
| 45 | 0.78033 |
| 46 | 0.78033 |
| 47 | 0.78033 |
| 48 | 0.78033 |
| 49 | 0.78033 |
| 50 | 0.78033 |
| 51 | 0.78033 |
| 52 | 0.78033 |
| 53 | 0.78033 |
| 54 | 0.78030 |
| 55 | 0.78033 |
| 56 | 0.78033 |

TABLE II-continued

| FUEL CAM PROFILE | |
|---|---|
| CAM SEC. | ROLLER LIFT |
| 57 | 0.78033 |
| 58 | 0.78033 |
| 59 | 0.78033 |
| 60 | 0.78033 |
| 61 | 0.78033 |
| 62 | 0.78033 |
| 63 | 0.78033 |
| 64 | 0.78033 |
| 65 | 0.78033 |
| 66 | 0.78027 |
| 67 | 0.78011 |
| 68 | 0.77980 |
| 69 | 0.77929 |
| 70 | 0.77854 |
| 71 | 0.77748 |
| 72 | 0.77608 |
| 73 | 0.77428 |
| 74 | 0.77204 |
| 75 | 0.76931 |
| 76 | 0.76604 |
| 77 | 0.76218 |
| 78 | 0.75770 |
| 79 | 0.75256 |
| 80 | 0.74570 |
| 81 | 0.74010 |
| 82 | 0.73274 |
| 83 | 0.72451 |
| 84 | 0.74547 |
| 85 | 0.70556 |
| 86 | 0.68475 |
| 87 | 0.68303 |
| 88 | 0.67038 |
| 89 | 0.66680 |
| 90 | 0.54229 |
| 91 | 0.62683 |
| 92 | 0.61045 |
| 93 | 0.59316 |
| 94 | 0.57497 |
| 95 | 0.55593 |
| 96 | 0.53606 |
| 97 | 0.51541 |
| 98 | 0.49404 |
| 99 | 0.47200 |
| 100 | 0.44937 |
| 101 | 0.42623 |
| 102 | 0.40267 |
| 103 | 0.37877 |
| 104 | 0.35465 |
| 105 | 0.33043 |
| 106 | 0.30621 |
| 107 | 0.28213 |
| 108 | 0.25832 |
| 109 | 0.23491 |
| 110 | 0.21205 |
| 111 | 0.18987 |
| 112 | 0.15851 |
| 113 | 0.14810 |
| 114 | 0.12877 |
| 115 | 0.11063 |
| 116 | 0.09380 |
| 117 | 0.07835 |
| 118 | 0.06436 |
| 119 | 0.05187 |
| 120 | 0.04090 |
| 121 | 0.03146 |
| 122 | 0.02350 |
| 123 | 0.01697 |
| 124 | 0.01176 |
| 125 | 0.00775 |
| 126 | 0.00480 |
| 127 | 0.00275 |
| 128 | 0.00142 |
| 129 | 0.00064 |
| 130 | 0.00023 |
| 131 | 0.00006 |
| 132 | 0.00001 |
| 133 | 0.00000 |

TABLE III

| AIR CAM PROFILE | |
|---|---|
| CAM SEC. | ROLLER LIFT |
| 0 | 0.00000 |
| 1 | 0.00010 |
| 2 | 0.00040 |
| 3 | 0.00080 |
| 4 | 0.00130 |
| 5 | 0.00200 |
| 6 | 0.00310 |
| 7 | 0.00440 |
| 8 | 0.00590 |
| 9 | 0.00740 |
| 10 | 0.00890 |
| 11 | 0.01040 |
| 12 | 0.01190 |
| 13 | 0.01340 |
| 14 | 0.01490 |
| 15 | 0.01540 |
| 16 | 0.01790 |
| 17 | 0.01940 |
| 18 | 0.02090 |
| 19 | 0.02240 |
| 20 | 0.02390 |
| 21 | 0.02540 |
| 22 | 0.02690 |
| 23 | 0.02840 |
| 24 | 0.02990 |
| 25 | 0.03150 |
| 26 | 0.03325 |
| 27 | 0.03525 |
| 28 | 0.02775 |
| 29 | 0.04089 |
| 30 | 0.04513 |
| 31 | 0.05067 |
| 32 | 0.05763 |
| 33 | 0.06608 |
| 34 | 0.07601 |
| 35 | 0.08742 |
| 36 | 0.10026 |
| 37 | 0.11445 |
| 38 | 0.12989 |
| 39 | 0.14647 |
| 40 | 0.16406 |
| 41 | 0.18251 |
| 42 | 0.20169 |
| 43 | 0.22146 |
| 44 | 0.24166 |
| 45 | 0.26217 |
| 46 | 0.28285 |
| 47 | 0.30358 |
| 48 | 0.32422 |
| 49 | 0.34469 |
| 50 | 0.36487 |
| 51 | 0.38467 |
| 52 | 0.40402 |
| 53 | 0.42283 |
| 54 | 0.44104 |
| 55 | 0.45860 |
| 56 | 0.47547 |
| 57 | 0.49159 |
| 58 | 0.50695 |
| 59 | 0.52151 |
| 60 | 0.53526 |
| 61 | 0.54820 |
| 62 | 0.56030 |
| 63 | 0.57158 |
| 64 | 0.58204 |
| 65 | 0.59169 |
| 66 | 0.50055 |
| 67 | 0.60864 |
| 68 | 0.61597 |
| 69 | 0.62257 |
| 70 | 0.62848 |
| 71 | 0.63372 |
| 72 | 0.63833 |
| 73 | 0.64234 |
| 74 | 0.54579 |
| 75 | 0.64872 |
| 76 | 0.55117 |
| 77 | 0.65318 |
| 78 | 0.66479 |

TABLE III-continued

| AIR CAM PROFILE | |
|---|---|
| CAM SEC. | ROLLER LIFT |
| 79 | 0.65605 |
| 80 | 0.65699 |
| 81 | 0.65767 |
| 82 | 0.65812 |
| 83 | 0.65840 |
| 84 | 0.65854 |
| 85 | 0.65859 |
| 86 | 0.65860 |
| 87 | 0.66860 |
| 88 | 0.65860 |
| 89 | 0.65860 |
| 90 | 0.65860 |
| 91 | 0.65860 |
| 92 | 0.65860 |
| 93 | 0.65860 |
| 93.25 | 0.65860 |

TABLE IV

| EXHAUST CAM PROFILE | |
|---|---|
| CAM SEC. | ROLLER LIFT |
| 0 | 0.00000 |
| 1 | 0.00010 |
| 2 | 0.00040 |
| 3 | 0.00080 |
| 4 | 0.00130 |
| 5 | 0.00200 |
| 6 | 0.00310 |
| 7 | 0.00440 |
| 8 | 0.00590 |
| 9 | 0.00740 |
| 10 | 0.00890 |
| 11 | 0.01040 |
| 12 | 0.01190 |
| 13 | 0.01340 |
| 14 | 0.01490 |
| 15 | 0.01540 |
| 16 | 0.01790 |
| 17 | 0.01940 |
| 18 | 0.02090 |
| 19 | 0.02240 |
| 20 | 0.02398 |
| 21 | 0.02540 |
| 22 | 0.02690 |
| 23 | 0.02940 |
| 24 | 0.02990 |
| 25 | 0.03150 |
| 26 | 0.03325 |
| 27 | 0.03525 |
| 28 | 0.03775 |
| 29 | 0.04089 |
| 30 | 0.04543 |
| 31 | 0.05067 |
| 32 | 0.05763 |
| 33 | 0.06608 |
| 34 | 0.07601 |
| 35 | 0.08742 |
| 36 | 0.10026 |
| 37 | 0.14445 |
| 38 | 0.12989 |
| 39 | 0.14547 |
| 40 | 0.15406 |
| 41 | 0.18251 |
| 42 | 0.20169 |
| 43 | 0.22146 |
| 44 | 0.24166 |
| 45 | 0.26217 |
| 46 | 0.28285 |
| 47 | 0.30358 |
| 48 | 0.32422 |
| 49 | 0.34469 |
| 50 | 0.35487 |
| 51 | 0.38467 |
| 52 | 0.40402 |
| 53 | 0.42283 |
| 54 | 0.44104 |
| 55 | 0.45860 |
| 56 | 0.47547 |

TABLE IV-continued

| EXHAUST CAM PROFILE | |
|---|---|
| CAM SEC. | ROLLER LIFT |
| 57 | 0.49169 |
| 58 | 0.50695 |
| 59 | 0.52151 |
| 60 | 0.53526 |
| 61 | 0.54820 |
| 62 | 0.56030 |
| 63 | 0.57158 |
| 64 | 0.58204 |
| 65 | 0.59169 |
| 66 | 0.60055 |
| 67 | 0.60864 |
| 68 | 0.61587 |
| 69 | 0.62257 |
| 70 | 0.62848 |
| 71 | 0.63372 |
| 72 | 0.63833 |
| 73 | 0.64234 |
| 74 | 0.64579 |
| 75 | 0.64872 |
| 76 | 0.65117 |
| 77 | 0.65318 |
| 78 | 0.65479 |
| 79 | 0.65605 |
| 80 | 0.65688 |
| 81 | 0.65767 |
| 82 | 0.65842 |
| 83 | 0.65840 |
| 84 | 0.65854 |
| 85 | 0.65859 |
| 86 | 0.65860 |
| 87 | 0.65860 |
| 88 | 0.65860 |
| 89 | 0.65860 |
| 90 | 0.65860 |
| 91 | 0.65860 |
| 92 | 0.65860 |
| 93 | 0.65860 |
| 94 | 0.65860 |
| 95 | 0.65860 |
| 96 | 0.65860 |
| 97 | 0.65860 |

FIG. 3C also shows the positioning of an exhaust cam roller 95 in a similar manner as the fuel and air cam rollers shown in FIGS. 3A and 3B. It will be recognized that Tables II–IV represent nominal lifts. As known in the art, a cam profile corresponding to the outer contour of a lobe of a cam may be determined by rolling a roller about the lobe area to determine the actual cam profile.

Each cam (see FIGS. 3A–3B) has an unique cam profile and base circle **96*a*–96*c* diameter. The base circle of each cam has a diameter of at least 3.75 inches. Each of the cams has an annular profile extending circumferentially about a portion of the base circle of each of the cams. Each of the cams further includes an opening flank generally indicated at 100, a closing flank generally indicated at 102 and a dwell portion generally indicated at 104**. The fuel cam is adapted with a lift section to provide a fuel cam lift to fuel pump plunger lift ratio of at least 0.8:1.0.

As seen in FIGS. 3A–3C and FIG. 4, a unit cam section 20, configured as the first (right side) unit cam section 106, has a predetermined cam orientation between the fuel cam and the air cam and the fuel cam and the exhaust cam. Likewise, a unit cam section 20, configured as a second (left side) unit cam section has a slightly different cam orientation due to the typical "V"-type engine configuration.

The fuel cam to air cam angle of the first unit cam section is between 56° and 63°. The fuel cam to air cam angle is defined by an angle between a fuel cam reference line 110 and an air cam line 112. The fuel cam reference line 110 is defined by a first point and a second point wherein the first point 114 corresponds to a location of a center axis of the fuel cam roller 40 which is at a position along the opening flank 100 of the fuel cam 94 where the fuel cam engages the inverted fuel rocker mechanism 36 when the piston is at top dead center during a fuel injection portion of an engine cycle. The second point 116 corresponds to a center axis of the base circle 96c of the fuel cam.

The air cam line 112 is defined by a first point 118 corresponding to a location of a center axis of an air cam roller which is at a position along the opening flank 98 of the air cam 90 corresponding to a location on the opening flank of the air cam where the air cam 90 causes the air valves to start to open. The second point 120 for the air cam line 112 corresponds to the center axis of the base circle 96a of the air cam.

The unit cam section 20 also has a fuel cam to exhaust cam angle of between 143° and 153°. The fuel cam to exhaust cam angle is defined by an angle between the fuel cam reference line 110 and an exhaust cam line 122. The exhaust cam line 122 is defined by a first point 124 corresponding to a location of a center axis of an exhaust cam roller which is at a position along the opening flank 98 of the exhaust cam 92 corresponding to a location on the opening flank of the exhaust cam 92 where the exhaust cam causes the exhaust valves to start to open. The second point 126 corresponds to the center axis of the base circle 96b of the exhaust cam.

As similarly defined, the second unit cam section 108 has a fuel cam to air cam angle of between 0° and 7°, and a fuel cam to exhaust cam angle of between 88° and 98°. The second unit cam section 108 has a preferred fuel cam to air cam angle of between 5° and 7° and a fuel cam to exhaust cam angle of between 92° and 94° and a lift ratio of 1:1.

Figure 4A:
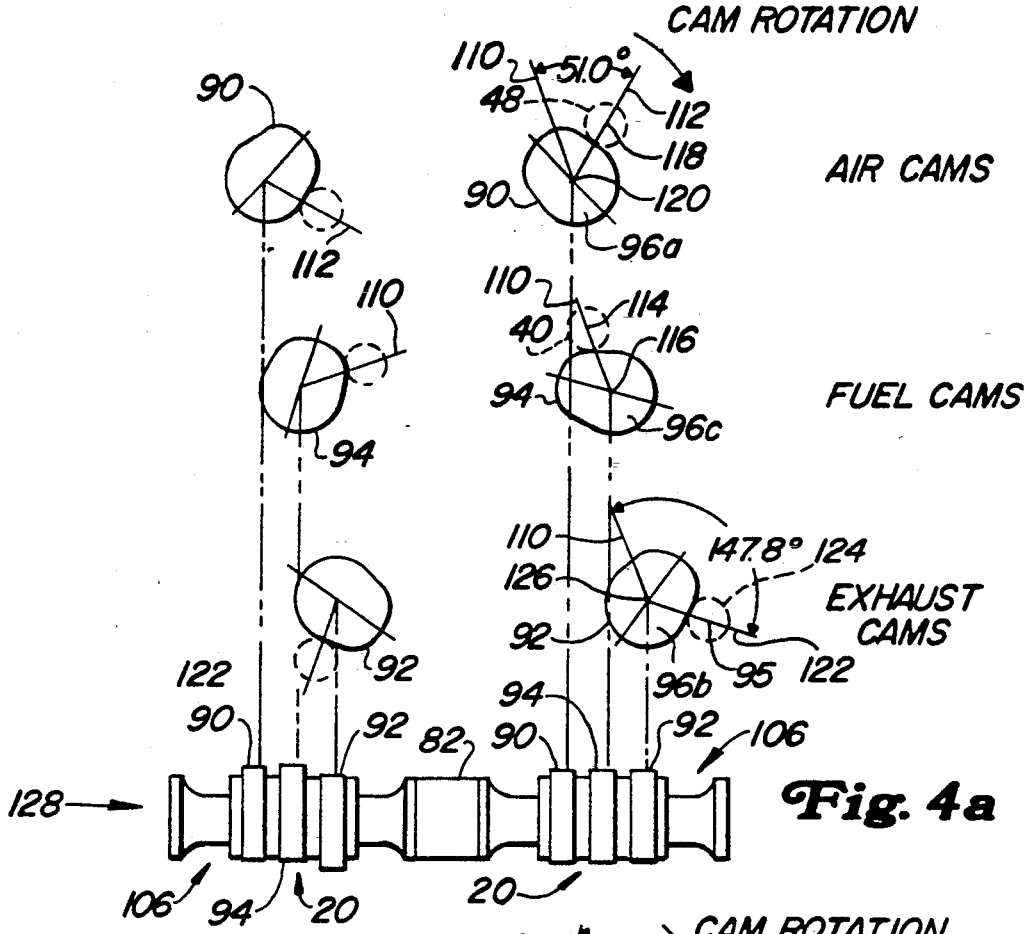
FIGS. 4A and B are partial plan views of a plurality of unit cam sections for a first and second bank of cylinders and illustrate the cam orientation for each unit cam section in accordance with the invention.
Figure 4B:
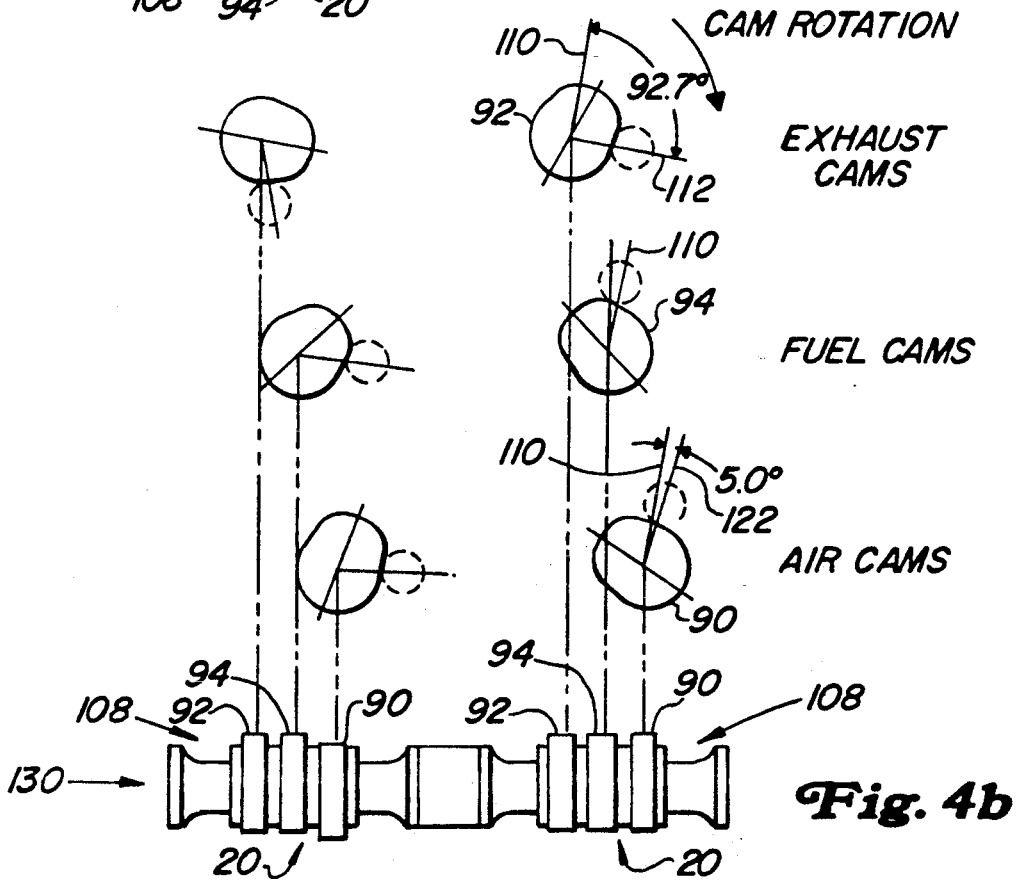

FIG. 4 also illustrates the inventive cam orientation for a plurality of interconnected unit cam sections for each bank of cylinders. A right bank cam shaft portion 128 and a left bank cam shaft portion 130 each have two unit cam sections 20 connected by spacers 82. Although not shown, any suitable number of unit cam spacers may be employed depending on the number of engine cylinders. The right camshaft portion may be used for a right bank of cylinders and the left camshaft portion 102 may be used for a left bank of cylinders as is typical with an ALCO 251 diesel engine.

The cam orientation for each unit cam section for a same side of the engine (those used for the same bank of cylinders) is substantially identical. The fuel cam is angularly displaced with respect to both the air cam and the exhaust cam to achieve an optimum fuel consumption level at relatively high engine loading. Referring to FIG. 4, the preferred nominal angle displacement for the air cam of the first unit cam section 106 is shown at an angle of approximately 61.0° from the fuel reference line 110. The exhaust line 114 is shown at a nominal angle displacement of 147.8° from the fuel cam reference line. The preferred nominal fuel cam to air cam angle range is between 60° and 62° and the preferred fuel cam to exhaust cam angle range is between 147° and 149°. The preferred lift ratio is 1:1.

For the second unit cam section 108, the preferred nominal angle displacement for the air cam is shown at an angle of approximately 6.00° from the fuel reference line 110. The exhaust line 114 is shown at a preferred nominal angle displacement of 92.7° from the fuel cam reference line.

Table V illustrates cam timing in crankshaft degrees from top dead center (TDC) firing between an old ALCO 251 engine design (using a CV type fuel pump and a unit cam section having a 1:1 fuel cam lift ration) and two new designs. It will be recognized that the valve open numbers in Table V were measured after valve lash (appropriately 0.034 inch).

TABLE V

| | New Design No. 2 | New Design No. 1 | Prior Design |
|---|---|---|---|
| | LEFT BANK | | |
| AIR VALVE | | | |
| Open | 292.9 | 292.9 | 285.5 |
| Close | 581.4 | 581.4 | 576.5 |
| Duration | 288.5 | 288.5 | 291.0 |
| EXHAUST VALVE | | | |
| Open | 119.4 | 119.4 | 117.7 |
| Close | 422.9 | 422.9 | 421.1 |
| Duration | 303.5 | 303.5 | 303.4 |
| VALVE OVERLAP | 130.0 | 130.0 | 135.6 |
| FUEL CAM NOMINAL LIFT AT TDC (INCHES) | 0.443 | 0.486 | 0.486 |
| | RIGHT BANK | | |
| AIR VALVE | | | |
| Open | 293.0 | 293.0 | 287.6 |
| Close | 581.5 | 581.5 | 578.5 |
| Duration | 288.5 | 288.5 | 290.9 |
| EXHAUST VALVE | | | |
| Open | 119.5 | 119.5 | 119.5 |
| Close | 423.0 | 423.0 | 423.0 |
| Duration | 303.5 | 303.5 | 303.5 |
| VALVE OVERLAP | 130.0 | 130.0 | 135.6 |
| FUEL CAM NOMINAL LIFT AT TDC (INCHES) | 0.441 | 0.482 | 0.482 |

New design #1 employs a CV type pump and a unit cam section having a 1:1 lift ratio but with a different cam orientation than the older design. New design #2 employs the CQ type fuel pump and a cam section having a 1:1 fuel lift ratio of 1:1 but with a different cam orientation than both the old design and the new design #1. It was found that new design #1 increased fuel efficiency by approximately 1.5% over the older design.

It has been found that a new design #2 ALCO 251 diesel engine using the CQ type pump (having characteristics similar to those shown in FIG. 5) in conjunction with the cam profiles and cam orientations, facilitate an improved fuel efficiency of between 1 and 2.4% brake specific fuel consumption (BSFC) over the new design #1 (it should be noted that testing was done with one cylinder so that BSFC numbers may vary for a multicylinder engine due to differences in the friction power). This dramatic increase allows current users of such engines to improve performance of their existing engines by changing from the CV type fuel pump to the well known CQ type fuel pump and replacing the existing unit cam section with the aforedescribed unit cam section having the defined cam orientation.

As previously mentioned, the improved direct fuel injection diesel engine, such as an ALCO 251 diesel engine incorporating the aforedescribed unit cam sections in conjunction with a CQ type fuel pump, can offer a fuel efficiency increase of between 1%–2.4% BSFC. Such an engine includes the plurality of unit cam sections 106 and 108 which have integrally formed air cams, fuel cams and exhaust cams and a base circle portion for each cam with a diameter of at least 3.75 inches. The engine includes an inverted fuel rocker mechanism 16 (shown in FIG. 1) which is cooperative with the fuel cam. The engine also has a fuel pump, such as a CQ type fuel pump, having a fuel plunger mechanism responsive to the rocker mechanism 16. The fuel cam 20 is adapted to provide a fuel cam lift to fuel pump plunger lift ratio of at least 0.8:1.0.

While the method and devices herein described constitute the preferred embodiment of the invention, it is to be understood that the invention is not limited to these precise methods and devices and that changes may be made therein without departing from the scope of the invention which is defined in the appended claims. For example, although the invention was described with reference to direct injection diesel engine for locomotive applications, the inventive unit cam sections may be suitable for other diesel engine applications such as marine applications or any other diesel engine applications.

What is claimed is:

1. A unit cam section for use with a single cylinder and piston in a "V"-type fuel injected diesel engine wherein the unit cam section, having a longitudinal center axis, includes a plurality of cams for the single cylinder and piston wherein each of the cams has a base circle, the center of each base circle lying along the longitudinal center axis, and the plurality of cams include a fuel cam, interposed between an air cam and an exhaust cam, such that the fuel cam moves a fuel pump plunger mechanism for facilitating fuel flow to the cylinder, the air cam moves air valve means and the exhaust cam moves exhaust valve means, wherein each cam has an opening flank portion and a closing flank portion and a predetermined cam profile, the unit cam section being cooperative with an inverted fuel rocker mechanism and comprises:

a base circle diameter of at least 3.75 inches for each cam;

the fuel cam adapted to provide a fuel cam lift to fuel pump plunger lift ratio of at least 0.8:1.0; and a predetermined cam orientation between the fuel cam and the air cam and the fuel cam and the exhaust cam such that:

a fuel cam to air cam angle is between 56° and 63° wherein the fuel cam to air cam angle is defined by an angle between a fuel cam reference line and an air cam line, the fuel cam reference line being defined by a first point, corresponding to a location of a center axis of a fuel cam roller which is at a position along the opening flank of the fuel cam where the fuel cam engages the inverted fuel rocker mechanism when the piston means is substantially at top dead center during a fuel injection portion of an engine cycle, and a second point corresponding to a center axis of the base circle of the fuel cam; the air cam line being defined by a first point corresponding to a location of a center axis of an air cam roller which is at a position along the opening flank of the air cam corresponding to a location on the opening flank of the air cam where the air cam causes the air valve means to start to open, and a second point corresponding to the center axis of the base circle of the air cam; and a fuel cam to exhaust cam angle is between 143° and 153° wherein the fuel cam to exhaust cam angle is defined by an angle between the fuel cam reference line and an exhaust cam line defined by a first point corresponding to a location of a center axis of an exhaust cam roller which is at a position along the opening flank of the exhaust cam corresponding to a location on the opening flank of the exhaust cam where the exhaust cam causes the exhaust valve means to start to open, and a second point corresponding to the center axis of the base circle of the exhaust cam.

2. The unit cam section of claim 1 further adapted to be laterally inserted into the engine or laterally removed from the engine.

3. The unit cam section of claim 2 further adapted to connect with another unit cam through spacer means to form a cam shaft for a plurality of cylinders.

4. The unit cam section of claim 1 wherein the fuel cam facilitates movement of a fuel pump plunger having a fuel port closure of between 0.117 inches and 0.177 inches.

5. The unit cam section of claim 4 wherein the fuel pump is a CQ type fuel pump in an ALCO 251 type diesel engine.

6. A unit cam section for use with a single cylinder and piston in a "V"-type fuel injected diesel engine wherein the unit cam section, having a longitudinal center axis, includes a plurality of cams for the single cylinder and piston wherein each of the cams has a base circle, the center of each base circle lying along the longitudinal center axis, and the plurality of cams include a fuel cam, interposed between an air cam and an exhaust cam, such that the fuel cam moves a fuel pump plunger mechanism for facilitating fuel flow to the cylinder, the air cam moves air valve means and the exhaust cam moves exhaust valve means, wherein each cam has an opening flank portion and a closing flank portion and a predetermined cam profile, the unit cam section being cooperative with an inverted fuel rocker mechanism and comprises:

a base circle diameter of at least 3.75 inches for each cam;

the fuel cam adapted to provide a fuel cam lift to fuel pump plunger lift ratio of at least 0.8:1.0; and a predetermined cam orientation between the fuel cam and the air cam and the fuel cam and the exhaust cam such that:

a fuel cam to air cam angle is between 0° and 7° wherein the fuel cam to air cam angle is defined by an angle between a fuel cam reference line and an air cam line, the fuel cam reference line being defined by a first point, corresponding to a location of a center axis of a fuel cam roller which is at a position along the opening flank of the fuel cam where the fuel cam engages the inverted fuel rocker mechanism when the piston means is substantially at top dead center during a fuel injection portion of an engine cycle, and a second point corresponding to a center axis of the base circle of the fuel cam; the air cam line being defined by a first point corresponding to a location of a center axis of an air cam roller which is at a position along the opening flank of the air cam corresponding to a location on the opening flank of the air cam where the air cam causes the air valve means to start to open, and a second point corresponding to the center axis of the base circle of the air cam; and a fuel cam to exhaust cam angle is between 88° and 98° wherein the fuel cam to exhaust cam angle is defined by an angle between the fuel cam reference line and an exhaust cam line defined by a first point corresponding to a location of a center axis of an exhaust cam roller which is at a position along the opening flank of the exhaust cam corresponding to a location on the opening flank of the exhaust cam where the exhaust cam causes the exhaust valve means to start to open, and a second point corresponding to the center axis of the base circle of the exhaust cam.

7. The unit cam section of claim 6 further adapted to be laterally inserted into the engine or laterally removed from the engine.

8. The unit cam section of claim 7 further adapted to connect with another unit cam through spacer means to form a cam shaft for a plurality of cylinders.

9. The unit cam section of claim 6 wherein the fuel cam facilitates movement of a fuel pump plunger having a fuel port closure of between 0.117 inches and 0.177 inches.

10. The unit cam section of claim 9 wherein the fuel pump is a CQ type fuel pump in an ALCO 251 type diesel engine.

11. An improved "V"-type direct fuel injection diesel engine having a first combustion cylinder on one side of the engine and a second combustion cylinder on another side of the engine wherein each cylinder has a corresponding piston means, the engine comprising:

a first unit cam section associated with said first combustion cylinder;

a second unit cam section associated with said second combustion cylinder;

said first and second unit cam sections having at least an integrally formed air cam, fuel cam and exhaust cam and a base circle portion for each cam with a diameter of at least 3.75 inches;

inverted fuel rocker means associated with each cylinder and cooperative with said fuel cams;

fuel pump means associated with each cylinder and having a fuel plunger mechanism responsive to said inverted fuel rocker means;

said fuel cams adapted to provide a fuel cam lift to fuel pump plunger lift ratio of at least 0.8:1.0; and said first unit cam section having a predetermined cam orientation between said fuel cam and said air cam and said fuel cam and said exhaust cam such that:

a fuel cam to air cam angle is between 56° and 63° wherein the fuel cam to air cam angle is defined by an angle between a fuel cam reference line and an air cam line, said fuel cam reference line being defined by a first point, corresponding to a location of a center axis of a fuel cam roller which is at a position along an opening flank of said fuel cam where said fuel cam engages said inverted fuel rocker mechanism when the piston means is at substantially top dead center during a fuel injection portion of an engine cycle, and a second point corresponding to a center axis of the base circle of said fuel cam; said air cam line being defined by a first point corresponding to a location of a center axis of an air cam roller which is at a position along an opening flank of the air cam corresponding to a location on the opening flank of said air cam where said air cam causes air valve means to start to open, and a second point corresponding to the center axis of the base circle of said air cam; and a fuel cam to exhaust cam angle is between 143° and 153° wherein said fuel cam to exhaust cam angle is defined by an angle between said fuel cam reference line and an exhaust cam line defined by a first point corresponding to a location of a center axis of an exhaust cam roller which is at a position along an opening flank of said exhaust cam corresponding to a location on said opening flank of said exhaust cam where said exhaust cam causes exhaust valve means to start to open, and a second point corresponding to the center axis of the base circle of said exhaust cam;

said second unit cam section having a predetermined cam orientation between said fuel cam and said air cam and said fuel cam and said exhaust cam such that:

said fuel cam to air cam angle is between 0° and 7°; and said fuel cam to exhaust cam angle is between 88° and 98°.

* * * * *